US008341970B2

(12) United States Patent
Ouchi et al.

(10) Patent No.: US 8,341,970 B2
(45) Date of Patent: Jan. 1, 2013

(54) REFRIGERATION EQUIPMENT WITH CONTROL SYSTEM AND DEVICE FOR CONTROLLING DEFROSTING OPERATION

(75) Inventors: Atsushi Ouchi, Takatsuki (JP); Yoshio Ozawa, Hirakata (JP)

(73) Assignee: SANYO Electric Co., Ltd., Moriguchi-Shi (JP)

( * ) Notice: Subject to any disclaimer, the term of this patent is extended or adjusted under 35 U.S.C. 154(b) by 980 days.

(21) Appl. No.: 12/394,837

(22) Filed: Feb. 27, 2009

(65) Prior Publication Data

US 2009/0217684 A1 Sep. 3, 2009

(30) Foreign Application Priority Data

Feb. 29, 2008 (JP) ..... 2008-051079

(51) Int. Cl.
*F25D 21/06* (2006.01)

(52) U.S. Cl. ..... 62/155; 62/151; 62/234

(58) Field of Classification Search ..... 62/126, 62/150, 151, 155, 157, 199, 234; 700/276, 700/277, 278
See application file for complete search history.

(56) References Cited

U.S. PATENT DOCUMENTS

| | | | | | |
|---|---|---|---|---|---|
| 4,251,988 | A * | 2/1981 | Allard et al. | 62/80 |
| 4,411,139 | A * | 10/1983 | Bos | 62/126 |
| 4,528,821 | A * | 7/1985 | Tershak et al. | 62/153 |
| 4,709,554 | A * | 12/1987 | Umemura et al. | 62/156 |
| 4,750,332 | A * | 6/1988 | Jenski et al. | 62/80 |
| 4,751,825 | A * | 6/1988 | Voorhis et al. | 62/234 |
| 4,887,436 | A * | 12/1989 | Enomoto et al. | 62/155 |
| 4,959,968 | A * | 10/1990 | Fukuda | 62/155 |
| 4,989,413 | A * | 2/1991 | Fukuda | 62/155 |
| 5,186,016 | A * | 2/1993 | Nigo | 62/150 |
| 5,315,835 | A * | 5/1994 | Park | 62/80 |
| 5,483,804 | A * | 1/1996 | Ogawa et al. | 62/153 |
| 5,493,867 | A * | 2/1996 | Szynal et al. | 62/80 |
| 5,564,286 | A * | 10/1996 | Suse | 62/153 |
| 5,765,382 | A * | 6/1998 | Manning et al. | 62/154 |
| 6,430,948 | B2 * | 8/2002 | Okubo | 62/151 |
| 6,523,358 | B2 * | 2/2003 | Collins | 62/156 |
| 6,606,870 | B2 * | 8/2003 | Holmes et al. | 62/155 |
| 6,631,620 | B2 * | 10/2003 | Gray et al. | 62/156 |
| 6,837,060 | B2 * | 1/2005 | Collins | 62/156 |
| 7,716,936 | B2 * | 5/2010 | Bailey et al. | 62/151 |
| 2002/0088238 | A1 * | 7/2002 | Holmes et al. | 62/155 |

(Continued)

FOREIGN PATENT DOCUMENTS

JP 05-272860 A 10/1993

*Primary Examiner* — Cheryl J Tyler
*Assistant Examiner* — Paolo Gonzalez
(74) *Attorney, Agent, or Firm* — NDQ&M Watchstone LLP

(57) ABSTRACT

An equipment control system includes a control device, and a control program in which present-round defrosting operation start time can be changed appropriately. An integrated controller controls a defrosting operation to remove frost adhered to showcases, in which the defrosting operation is started at a fixed or varying time interval. The integrated controller stores past record data based on required time for past defrosting operations for different environmental conditions. The integrated controller includes an environmental condition acquisition unit for obtaining present environmental conditions; a database control unit for obtaining required time for a present-round defrosting operation based on the past record data corresponding to the present environmental conditions from among the stored past record data; and a start time changing unit for changing start time of the present-round defrosting operation based on the obtained required time from the scheduled start time.

7 Claims, 12 Drawing Sheets

U.S. PATENT DOCUMENTS

2002/0139132 A1* 10/2002 Collins ..... 62/156
2003/0000233 A1* 1/2003 Mazereeuw ..... 62/126
2005/0086955 A1* 4/2005 Rafalovich et al. ..... 62/156
2006/0090482 A1* 5/2006 Dawes ..... 62/126
2006/0117766 A1* 6/2006 Singh et al. ..... 62/129
2007/0180838 A1* 8/2007 Shah ..... 62/150
2007/0295015 A1* 12/2007 Bailey et al. ..... 62/150

* cited by examiner

FIG. 3

| | CASE 1 | | CASE 2 | | | | | |
|---|---|---|---|---|---|---|---|---|
| | INSIDE TEMPERATURE OF SHOWCASE | OPERATION MODE | INSIDE TEMPERATURE OF SHOWCASE | OPERATION MODE | ··· | OUTSIDE AIR TEMPERATURE | IN-STORE TEMPERATURE | IN-STORE HUMIDITY |
| ··· | ··· | ··· | ··· | ··· | ··· | ··· | ··· | ··· |
| 11:55 | 3°C | NORMAL | −17°C | NORMAL | ··· | 22°C | 21°C | 55% |
| 11:56 | 3°C | NORMAL | −18°C | NORMAL | ··· | 22°C | 21°C | 57% |
| 11:57 | 2°C | NORMAL | −18°C | NORMAL | ··· | 23°C | 21°C | 57% |
| 11:58 | 2°C | NORMAL | −17°C | NORMAL | ··· | 23°C | 21°C | 56% |
| 11:59 | 3°C | NORMAL | −19°C | NORMAL | ··· | 22°C | 21°C | 57% |
| 12:00 | 2°C | NORMAL | −19°C | NORMAL | ··· | 22°C | 21°C | 55% |
| 12:01 | 2°C | DEFROSTING | −20°C | NORMAL | ··· | 23°C | 21°C | 55% |
| 12:02 | 3°C | DEFROSTING | −20°C | NORMAL | ··· | 22°C | 22°C | 57% |
| 12:03 | 3°C | DEFROSTING | −19°C | NORMAL | ··· | 22°C | 22°C | 57% |
| 12:04 | 4°C | DEFROSTING | −19°C | NORMAL | ··· | 22°C | 22°C | 56% |
| 12:05 | 5°C | DEFROSTING | −18°C | NORMAL | ··· | 22°C | 22°C | 56% |
| ··· | ··· | ··· | ··· | ··· | ··· | ··· | ··· | ··· |

FIG. 4

| | | | | | | |
|---|---|---|---|---|---|---|
| DEFROSTING GROUP 1 | CASE | CASE 1, CASE 2, CASE 3 | | | | |
| | START TIME | 0:00 | 4:00 | 8:00 | 12:00 | 16:00 | 20:00 |
| | PROHIBITION TIME | 10:00—11:00 | | 15:00—16:00 | | | |
| DEFROSTING GROUP 2 | CASE | CASE 4, CASE 5 | | | | | |
| | START TIME | 2:30 | 8:30 | 12:30 | 14:30 | 20:30 | |
| | PROHIBITION TIME | 10:00—11:00 | | 15:00—16:00 | | | |
| DEFROSTING GROUP 3 | CASE | CASE 6, CASE 7 | | | | | |
| | START TIME | 1:00 | 7:00 | 13:00 | 19:00 | | |
| | PROHIBITION TIME | 10:00—11:00 | | 15:00—16:00 | | | |
| ... | ... | ... | ... | ... | ... | | |

| | DEFROSTING TIME | RECOVERY TIME |
|---|---|---|
| DATA 1 | 15 MIN | 28 MIN |
| DATA 2 | 18 MIN | 32 MIN |
| ... | ... | ... |
| DATA 10 | | |
| AVERAGE | 16 MIN | 29 MIN |

REFRIGERATION EQUIPMENT WITH CONTROL SYSTEM AND DEVICE FOR CONTROLLING DEFROSTING OPERATION

CROSS REFERENCE TO RELATED APPLICATIONS

This application claims priority based on 35 USC 119 from prior Japanese Patent Application No. P2008-051079 filed on Feb. 29, 2008, the entire contents of which are incorporated herein by reference.

BACKGROUND OF THE INVENTION

1. Field of the Invention

The invention relates to an equipment control system for equipment such as a refrigeration device for cooling a space to be cooled, a control device for controlling the refrigeration device, and a control program used in the control device.

2. Description of Related Art

A refrigeration device for cooling a space to be cooled such as a showcase installed in a store, such as a supermarket or a convenience store, has been widely used in the past. The space to be cooled for example indicates an inside of the showcase for displaying merchandises. At a cooling unit of such a cooling device, moisture in the air adheres as frost, and therefore, a defrosting operation is performed periodically in which the temperature within the space to be cooled is raised and the frost adhered to the refrigeration device is removed. Here, the frost adhered to the refrigeration device indicates, for example, the frost adhered to the cooling unit of the refrigeration device and the frost adhered to the wall surface inside the showcase. By periodically removing the frost adhered to the cooling device, a good cooling performance of the refrigeration device can be maintained.

It is common that the defrosting operation is performed from its start until a predetermined termination condition is met. Here, the termination condition is for example that the temperature within the space to be cooled reached a given temperature. Therefore, when the time required for the defrosting takes longer, it is considered that a larger amount of frost is adhered to the refrigeration device at the time of the defrosting.

In view of this, Japanese patent Laid-Open No. 5-272860 proposes a method to change start time of a present-round defrosting operation from scheduled start time in accordance with the time required for the last defrosting operation. In particular, if the last defrosting operation took a long time, it is considered that it has a tendency to have a large amount of adhered frost, and the start time for the present-round defrosting operation is advanced from the scheduled start time. Also, if the last defrosting operation took a short time, it is considered that it has a tendency to have a small amount of adhered frost, and the start time for the present-round defrosting operations is delayed.

However, the defrosting operation is started at certain frequencies, such as in the four-hour or six-hour interval, and therefore, there is an instance in which environmental conditions such as the in-store temperature and the in-store humidity at the time of the last defrosting operation may differ greatly from the environmental conditions at the time of the present-round defrosting operation. Here, the environmental conditions at the time of the defrosting operation are the conditions that affect the required time for the defrosting operation. For example, in a case of the showcase, the amount of adhered frost varies in accordance with the in-store temperature, the outdoor air temperature, the in-store humidity, and so on.

Therefore, in the method of Japanese patent Laid-Open No. 5-272860 in which the start time for the present-round defrosting operation is changed according to the time required for the last defrosting operation, there was a problem that the tendency prediction for the amount of adhered frost may not be accurate, and the start time for the present-round defrosting operation may not be appropriately changed from the scheduled start time when the environmental conditions at the time of the last defrosting operation differ greatly from the environmental conditions at the time of the present-round defrosting operation.

Thus, the present invention was made to solve such a problem and provides the equipment control system, the control device and the control program that can change the start time of the present-round defrosting operation appropriately even when environmental conditions at the time of the last defrosting operation differ greatly from the environmental conditions at the time of the present-round defrosting operation.

SUMMARY OF THE INVENTION

The invention was made in consideration of the above and includes the characteristics as described below.

One aspect of the invention is an equipment control system (equipment control system 1) including a refrigeration device (showcases 53, 54, 55, . . . ) for cooling a space to be cooled, and a control device (integrated controller 10) for controlling a defrosting operation to remove frost adhered to the refrigeration device which is started at a fixed or varying time interval, in which the equipment control system further includes a past record data memory unit (database based on environmental conditions 13) for storing past record data based on required time for past defrosting operations for different environmental conditions; an environmental condition acquisition unit (environmental condition acquisition unit 141) for obtaining present environmental conditions; a required time prediction unit (database control unit 142) for estimating, at the time of or before starting a present-round defrosting operation, required time for a present-round defrosting operation based on the past record data corresponding to the present environmental conditions from among the past record data stored in the past record data memory unit; and a start time changing unit (start time changing unit 143) for changing start time of the present-round defrosting operation based on the estimated required time obtained at the required time prediction unit from start time that was scheduled based on the time interval. Here, the "defrosting operation" may include a "recovery operation" as will be described below. Also, the "environmental conditions" especially mean the information related to the operating environment of the refrigeration device that affects the amount of frost adhered to the refrigeration device. The temperature and humidity fall under a category of such environmental conditions.

According to such an equipment control system, the required time for the present-round defrosting operation is estimated in accordance with the required time for the past defrosting operations corresponding to the present environmental conditions, and the start time for the present-round defrosting operation is changed from the scheduled start time based on the estimated required time. Therefore, even when the environmental conditions at the time of the last defrosting operation differ greatly from the environmental conditions at the time of the present-round defrosting operation, the start time of the present-round defrosting operation can be changed appropriately.

In the above equipment control system, the start time changing unit may delay the start time of the present-round defrosting operation from the scheduled start time when the estimated required time obtained at the required time prediction unit falls below a predetermined amount of time.

According to such an equipment control system, when the estimated required time falls below the predetermined amount of time, the system considers that it has a tendency to have a small amount of adhered frost and delays the start time of the present-round defrosting operation from the scheduled start time. Thus, the time interval for the defrosting operations can be extended when it is considered that the amount of adhered frost is small, thus reducing the cost associated with the defrosting operation such as the electric power consumption.

In the above equipment control system, the start time changing unit may advance the start time of the present-round defrosting operation from the scheduled start time when the estimated required time obtained at the required time prediction unit exceeds a predetermined amount of time.

According to such an equipment control system, when the estimated required time exceeds the predetermined amount of time, the system considers that it has a tendency to have a large amount of adhered frost, and advances the start time of the present-round defrosting operation from the scheduled start time. Thus, the time interval for the defrosting operations can be shortened when it is considered that the amount of adhered frost is large, thus making it possible to maintain a good cooling performance of the refrigeration device.

In the above equipment control system, the start time changing unit may change the start time of the present-round defrosting operation from the scheduled start time such that the defrosting operation time period does not overlap with a prohibition time period in which the defrosting operation is prohibited.

According to such an equipment control system, the start time of the present-round defrosting operation can be changed from the scheduled start time while avoiding the overlap of the defrosting operation time period and the prohibition time period.

In the above equipment control system, the start time changing unit may delay the start time of the present-round defrosting operation until after finish time of the prohibition time period when the estimated required time obtained at the required time prediction unit falls below a predetermined amount of time and a temporal difference between the start time of the last defrosting operation and the finish time of the prohibition time period is below a certain value.

According to such an equipment control system, when the estimated required time falls below the predetermined amount of time, the system considers that it has a tendency to have a small amount of adhered frost and delays the start time of the present-round defrosting operation. This makes it possible to extend the time interval for the defrosting operations when it is considered that the amount of adhered frost is small, thus reducing the cost associated with the defrosting operation such as the electric power consumption.

In addition, when the temporal difference between the start time of the last defrosting operation and the finish time of the prohibition time period is below a certain value, in other words, when it is determined that the cooling performance of the refrigeration device is not impaired by delaying the start time of the present-round defrosting operation until after the finish time of the prohibition time period, the start time of the present-round defrosting operation is delayed until after the finish time of the prohibition time period. Therefore, it is possible to extend the time interval of the defrosting operations as much as possible while avoiding impairing the cooling performance of the refrigeration device as well as avoiding the overlap of the defrosting operation time period and the prohibition time period.

In the above equipment control system, the start time changing unit may delay the start time of the present-round defrosting operation such that finish time of the present-round defrosting operation comes before the start time of the prohibition time period when the estimated required time obtained at the required time prediction unit falls below a predetermined amount of time and the temporal difference between the start time of the last defrosting operation and the finish time of the prohibition time period exceeds a certain value.

According to such an equipment control system, when the temporal difference between the start time of the last defrosting operation and the finish time of the prohibition time period exceeds a certain value, in other words, when it is determined that the cooling performance of the refrigeration device may be impaired by delaying the start time of the present-round defrosting operation until after the finish time of the prohibition time period, the start time of the present-round defrosting operation is delayed such that the finish time of the present-round defrosting operation comes before the start time of the prohibition time period. Therefore, it is possible to extend the time interval of the defrosting operations as much as possible while avoiding impairing the cooling performance of the refrigeration device as well as avoiding the overlap of the defrosting operation time period and the prohibition time period.

In the above equipment control system, the refrigeration device may include a first refrigeration device (such as the showcase 53) and a second refrigeration device (such as the showcase 54) that is different from the first refrigeration device, and in a case that the start time of the present-round defrosting operation for the first refrigeration device is changed, the start time changing unit may set the start time of the present-round defrosting operation for the first refrigeration device to be different from the start time of the defrosting operation for the second refrigeration device.

According to such an equipment control system, the start time of the defrosting operation can be staggered among a plurality of the refrigeration devices by changing the start time of the defrosting operation for the first refrigeration device in such a way that the start time of the defrosting operation for the first refrigeration device does not overlap with the start time of the defrosting operation for the second refrigeration device, thus temporally spreading the cost associated with the defrosting operation such as the electric power consumption.

The above equipment control system may include a notification unit (display unit 18) for notifying to a user an effect that the start time of the present-round defrosting operation was changed from the scheduled start time or an effect that there is no change in the start time.

According to such an equipment control system, the user can grasp that the start time of the present-round defrosting operation was changed from the scheduled start time or that there is no change in the start time.

Another aspect of the invention is a control device for controlling a defrosting operation to remove frost adhered to a refrigeration device for cooling a space to be cooled, the defrosting operation being started at a fixed or varying time interval, in which the control device further includes a past record data memory unit for storing past record data based on required time for past defrosting operations for different environmental conditions; an environmental condition acquisition unit for obtaining present environmental conditions; a required time prediction unit for estimating, at the time of or before starting a present-round defrosting operation, required time for the present-round defrosting operation based on the past record data corresponding to the present environmental conditions from among the past record data stored in the past record data memory unit; and a start time changing unit for changing start time of the present-round defrosting operation based on the estimated required time obtained at the required time prediction unit from start time that was scheduled based on the time interval.

According to such a control device, similarly to the equipment control system of the invention, even when the environmental conditions at the time of the last defrosting operation differ greatly from the environmental conditions at the time of the present-round defrosting operation, the start time of the present-round defrosting operation can be changed appropriately.

Another aspect of the invention is a control program that causes a computer that functions as a control device for controlling a defrosting operation to remove frost adhered to a refrigeration device for cooling a space to be cooled, the defrosting operation being started at a fixed or varying time interval, to execute a procedure to store past record data based on required time for past defrosting operations for different environmental conditions; a procedure to obtain present environmental conditions; a procedure to estimate, at the time of or before starting a present-round defrosting operation, required time for the present-round defrosting operation based on the past record data corresponding to the present environmental conditions from among the past record data stored in the past record data memory unit; and a procedure to change start time of the present-round defrosting operation based on the estimated required time obtained at the required time prediction unit from start time that was scheduled based on the time interval.

According to such a control device, similarly to the equipment control system of the invention, even when the environmental conditions at the time of the last defrosting operation differ greatly from the environmental conditions at the time of the present-round defrosting operation, the start time of the present-round defrosting operation can be changed appropriately.

According to the characteristics of the invention, the equipment control system, the control device, and the control program are provided in which the start time of the present-round defrosting operation can be changed appropriately even when the environmental conditions at the time of the last defrosting operation greatly differ from the environmental conditions at the time of the present-round defrosting operation.

BRIEF DESCRIPTION OF THE DRAWINGS

FIG. 3 is a database configuration diagram of the operating condition database according to the embodiment.

FIG. 4 is a database configuration diagram of the operation schedule database according to the embodiment.

DETAILED DESCRIPTION OF EMBODIMENTS

Figure 1:
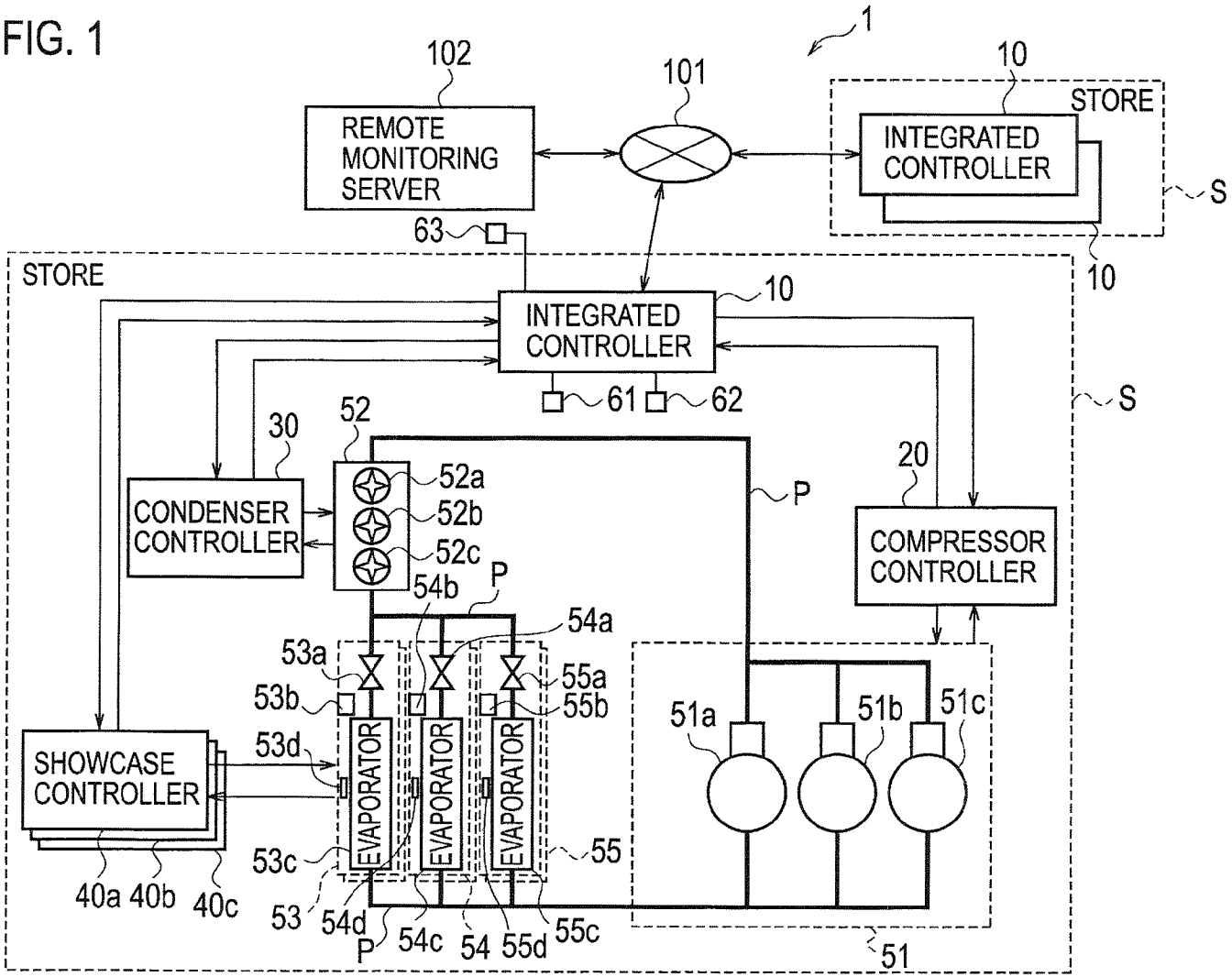
FIG. 1 is an overall general configuration diagram of the equipment control system according to an embodiment of the invention.

Next, embodiments of the invention will be described with reference to the accompanying drawings below. In particular, (1) overall general configuration of the equipment control system, (2) configuration of the integrated controller, (3) operations of the integrated controller, (4) operations and effects, and (5) other embodiments of the invention will be explained. The same or similar reference numbers are assigned for the same or similar parts in the drawings for the embodiments described below.

(1) Overall general configuration of the equipment control system

First, an overall general configuration of the equipment control system according to the embodiment, in particular, (1.1) general configuration of the equipment control system, (1.2) configuration of the refrigerant circulation circuit, (1.3) configuration of the showcase, and (1.4) general configuration of each controller will be explained.

(1.1) General Configuration of the Equipment Control System

FIG. 1 is an overall general configuration of an equipment control system 1. As shown in FIG. 1, the equipment control system 1 has an integrated controller 10 and has a configuration to integrally control a number of showcases 53, 54, and 55, . . . that refrigerate or freeze merchandises placed in a store S such as a supermarket or a convenience store.

In the example of FIG. 1, the integrated controller 10 installed at a plurality of stores S and a remote monitoring server 102 for communicating via the Internet 101 are provided. The remote monitoring server 102 obtains various data from the integrated controller 10 as well as sends to and sets up various data in the integrated controller 10.

(1.2) Configuration of the Refrigerant Circulation Circuit

As shown in FIG. 1, a refrigerant circulation circuit having a compressor 51, a condenser 52, showcases 53, 54, and 55, . . . , and refrigerant piping P is installed at the store S. Each of the compressor 51, the condenser 52, and showcases 53, 54, and 55, . . . is a constituent device that constitutes the refrigerant circulation circuit, and is connected by the refrigerant piping P.

The compressor 51 includes three compressors 51*a* to 51*c* having respectively different compression abilities. The refrigerant compressed by the compressor 51 is lead to the condenser 52 via the refrigerant piping P. The condenser 52 has fans 52*a* to 52*c* and condenses the refrigerant using the fans 52*a* to 52*c*. The refrigerant condensed by the condenser 52 is lead to the showcases 53, 54, and 55 . . . and is expanded and evaporates thus conducting the heat away from inside the showcases 53, 54, and 55, . . . at the time of evaporation. The evaporated refrigerant again is lead to the compressor 51 via the refrigerant piping P. By circulating the refrigerant as such, the merchandises placed in the showcases 53, 54, and 55, . . . are cooled.

(1.3) Configuration of the Showcase

The showcase 53 has an expansion valve 53*a*, a sensor 53*b*, an evaporator 53*c*, and a heater 53*d*. The refrigerant expands at the expansion valve 53*a* and evaporates at the evaporator 53*c*. The expansion valve 53*a* also has a function to adjust the flow volume of the refrigerant. The sensor 53*b* detects for example an inside temperature of the showcase 53.

The evaporator 53*c* functions as a heat exchanger and the moisture in the air adheres to the evaporator 53*c* as frost. When the frost is adhered to the evaporator 53*c*, the heat exchange at the evaporator 53*c* is disrupted and the cooling performance is deteriorated. Therefore, a defrosting operation is necessary, which is an operation mode to remove the frost by periodically raising the inside temperature of the showcase using the heater 53*d*. In this regard, the defrosting operation is not limited to the one using the heater 53*d*, but a defrosting operation in which the refrigerant flow is stopped by using the expansion valve 53*a* also may be performed.

The defrosting operation is performed during the time from its start until a predetermined termination condition is met. Such a termination condition is a condition that makes it possible to determine that the frost was removed, and for example, at least one of the inside temperature of the showcase, the temperature of the refrigerant, the inside humidity of the showcase, and the pressure of the refrigerant may be used as criteria for the termination condition. The time the defrosting operation is started will be called arbitrarily "defrosting start time"; the time that the defrosting operation ends will be called arbitrarily "defrosting finish time"; and the required time for the defrosting operation will be called arbitrarily "defrosting time" below.

Once the defrosting operation is performed, the inside temperature of the showcase becomes elevated, and thus, a recovery operation (pull-down operation) which is an operation mode to lower the raised inside temperature of the showcase is performed. The recovery operation is started to coincide with the termination of the defrosting operation. The recovery operation is performed during the time from its start until the inside temperature of the showcase returns to a preset temperature.

At the recovery operation, the inside temperature of the showcase is decreased rapidly, and therefore, the electric power consumption during the recovery operation is larger compared with the normal operation mode. Therefore, by reducing the number of defrosting operations the number of recovery operations can be reduced, which also reduces the electric power consumption. The time the recovery operation is started will be called arbitrarily "recovery start time"; the time that the recovery operation ends will be called arbitrarily "recovery finish time"; and the required time for the recovery operation will be called arbitrarily "recovery time" below.

The showcases 54, and 55, . . . are configured similarly to the showcase 53. Here, multiple showcases 53 are provided and constitute a defrosting group 1. The multiple showcases 53 that constitute the defrosting group 1 simultaneously start the defrosting operation. Also, multiple showcases 54 are provided and constitute a defrosting group 2. The multiple showcases 54 that constitute the defrosting group 2 simultaneously start the defrosting operation. Multiple showcases 55 are provided and constitute a defrosting group 3. The multiple showcases 55 that constitute the defrosting group 3 simultaneously start the defrosting operation.

During a certain time period, a fully refrigerated condition at the showcases 53, 54, and 55 . . . may be required. For example, during the time period in which an employee periodically checks the temperature of the showcases 53, 54, and 55 . . . to fill out a checklist, it is necessary that the showcases 53, 54, and 55 . . . are fully refrigerated. Also during the time period in which merchandises are restocked in the showcases 53, 54, and 55 . . . , it is necessary that the merchandises are fully refrigerated within a short time right after the restocking. In other words, the defrosting operation and the recovery operation are prohibited in such a time period, and the time period in which the defrosting operation and the recovery operation are prohibited will be called a "prohibition time period" below.

(1.4) General Configuration of each Controller

Various controllers are installed at the store S including the integrated controller 10. In particular, at the store S, a compressor controller 20 that controls the compressor 51, a condenser controller 30 that controls the condenser 52, showcase controllers 40*a*, 40*b*, and 40*c* . . . that control the showcases 53, 54, and 55 . . . , and the integrated controller 10 are installed. The compressor controller 20, the condenser controller 30, the showcase controllers 40*a*, 40*b*, and 40*c* . . . will be collectively called "device controllers" arbitrarily.

The showcase controllers 40*a*, 40*b*, and 40*c* . . . control the expansion valves 53*a*, 53*b*, and 53*c* . . . of the showcases 53, 54, and 55 . . . based on the sensor values outputted by the sensors 53*b*, 54*b*, and 55*b* . . . such that the inside temperatures of the showcases stay preset temperatures. Although it is common to provide the showcase controllers 40*a*, 40*b*, and 40*c* . . . in one-to-one correspondence with the showcases 53, 54, and 55 . . . , one showcase controller also may control multiple showcases instead.

The integrated controller 10 carries out mutual communication with the device controllers and systematically manages the operation status of the constituent devices to coordinate among the constituent devices. For example, the integrated controller 10 also has a function to perform an energy saving control in the entire store S. The integrated controller 10 may grasp the operation status of the showcases 53, 54, and 55 . . . by communication with the showcase controllers 40*a*, 40*b*, and 40*c* . . . . In addition, the integrated controller 10 may instruct the showcase controllers 40*a*, 40*b*, and 40*c* . . . to start the defrosting operation. In this embodiment, the integrated controller 10 constitutes a control device for controlling the defrosting operation of the showcases 53, 54, and 55 . . . (refrigeration devices).

An in-store temperature sensor 61, an in-store humidity sensor 62, and an outside air temperature sensor 63 are connected to the integrated controller 10. The in-store temperature sensor 61 detects the temperature within the store S and notifies the detection result to the integrated controller 10. The in-store humidity sensor 62 detects the humidity within the store S and notifies the detection result to the integrated controller 10. The outside air temperature sensor 63 detects the outside air temperature and notifies the detection result to the integrated controller 10. The temperature and humidity within the store S as well as the temperature outside the store S affect the amount of the adhered frost at the showcases 53, 54, and 55 . . . as well as the defrosting time. For example, when the humidity within the store S is higher, the amount of the adhered frost increases and the defrosting time takes longer. Also, when the temperature within the store S is higher, the defrosting time takes shorter.

(2) Configuration of the Integrated Controller

Next, a configuration of the integrated controller 10, in particular, (2.1) general configuration of the integrated controller, (2.2) database configuration, (2.3) main component of the integrated controller, and (2.4) example of screen display will be explained.

(2.1) General Configuration of the Integrated Controller

Figure 2:
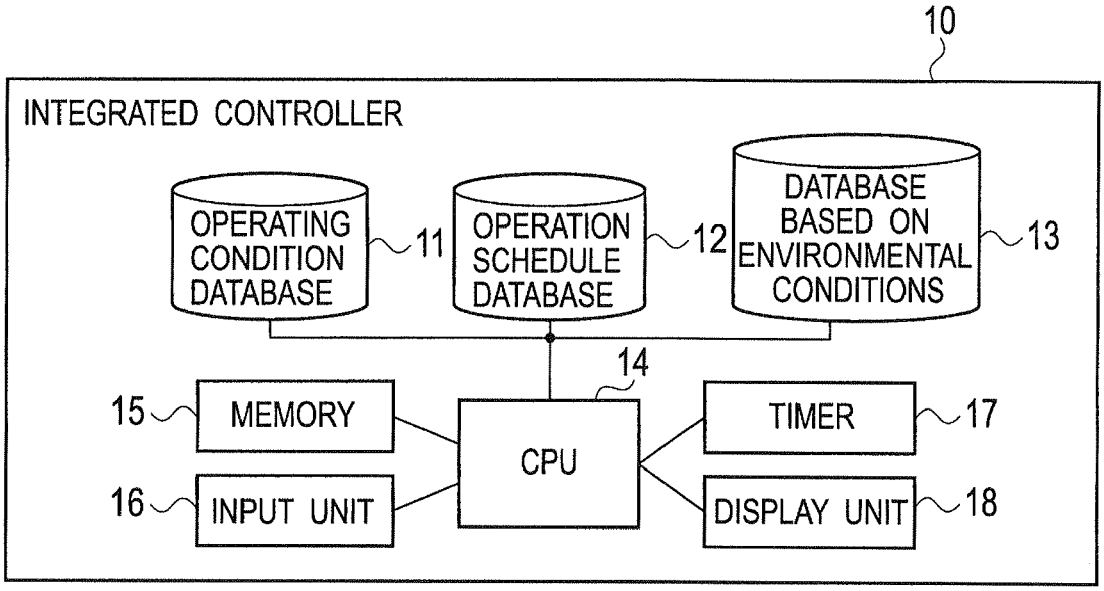
FIG. 2 is a general configuration of the integrated controller according to the embodiment.

FIG. 2 is a general configuration diagram of the integrated controller 10. The components relevant to the invention primarily will be explained below.

As shown in FIG. 2, the integrated controller 10 includes an operating condition database 11, an operation schedule database 12, a database based on environmental conditions 13, a CPU 14, a memory 15, an input unit 16, a timer 17, and a display unit 18.

The CPU 14 controls the entire integrated controller 10. The memory 15 stores a control program executed by the CPU 14 as well as various parameters. The input unit 16 is for example a keyboard and a mouse, and receives entry operations from a user. The timer 17 has a timekeeping function. The display unit 18 is composed of a display, and displays various information.

(2.2) Database Configuration

Next, a configuration of each database, in particular, (2.2.1) configuration of the operating condition database, (2.2.2) configuration of the operation schedule database, and (2.2.3) configuration of the database based on environmental conditions will be explained.

(2.2.1) Configuration of the Operating Condition Database

FIG. 3 is a database configuration diagram of the operating condition database 11. The operating condition database 11 is used for preparation and updating of the database based on environmental conditions 13.

As shown in FIG. 3, the operating condition database 11 stores periodically measured data of the operating conditions (such as the operation mode, inside temperature of the showcase, and the environmental conditions) for each showcase 53, 54, and 55 . . . . Here, the operation mode includes three operations, that is, the defrosting operation, the recovery operation, and the normal operation. In this embodiment, for example data measured at the one-minute interval is stored in the operating condition database 11.

In the example of FIG. 3, the inside temperature of each showcase, the operation mode of each showcase, the outside air temperature, the in-store temperature, and the in-store humidity are stored in correspondence. For example, at 11:55, contents such as that the inside temperature of the showcase 1 is 3° C.; the operation mode of the showcase 1 is the normal operation; the inside temperature of the showcase 2 is −17° C.; the operation mode of the showcase 2 is the normal operation; the outside air temperature is 22° C.; the in-store temperature is 21° C.; and the in-store humidity is 55% are stored.

(2.2.2) Operation Schedule Database Configuration

FIG. 4 is a database configuration diagram of the operation schedule database 12. In the operation schedule database 12, predetermined defrosting start time (scheduled start time) and a prohibition time period are stored on a daily basis for each defrosting group. In the initial state, the defrosting operation is started at the defrosting start time (scheduled start time) stored in the operation schedule database 12.

In the example of FIG. 4, for the defrosting group 1, the defrosting start time is set 6 times per day starting midnight at the four-hour interval, and the time periods from 10:00 to 11:00 and from 15:00 to 16:00 are set as the prohibition time periods. For the defrosting group 2, the defrosting start time is set 5 times per day starting at 2:30 at the four or six-hour interval, and the time periods from 10:00 to 11:00 and from 15:00 to 16:00 are set as the prohibition time periods. For the defrosting group 3, the defrosting start time is set 4 times per day starting at 1:00 at the six-hour interval, and the time periods from 10:00 to 11:00 and from 15:00 to 16:00 are set as the prohibition time periods. As such, for each defrosting group, the defrosting start time is set so that it does not overlap with that of other defrosting groups.

(2.2.3) Configuration of Database Based on Environmental Conditions

Figures 5A, 5B:
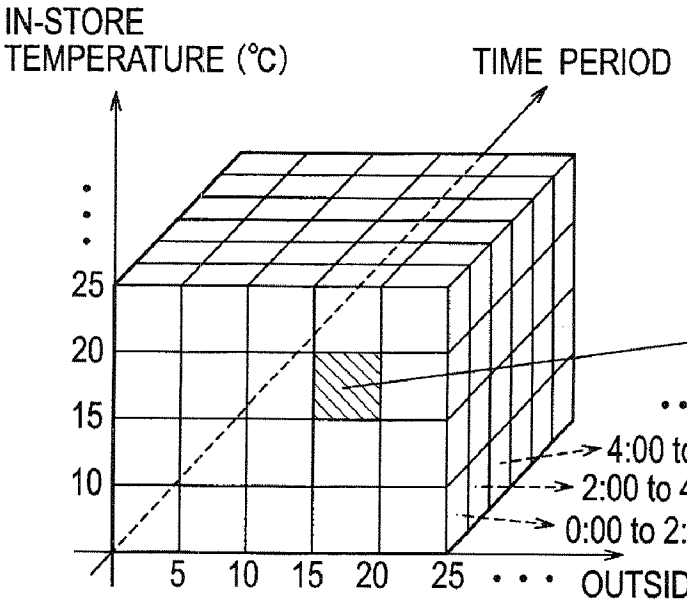
FIGS. 5A and 5B are database configuration diagrams of the database based on the environmental conditions according to the embodiment.

FIGS. 5A and 5B are database configuration diagrams of the database based on environmental conditions 13. The database based on environmental conditions 13 stores past record data based on the past defrosting time and recovery time (such as average defrosting time and average recovery time) for different environmental conditions. In this embodiment, the database based on environmental conditions 13 constitutes a past record data memory unit that stores past record data based on the past defrosting time and recovery time for different environmental conditions.

In the example of FIG. 5A, three environmental conditions, that is, the in-store temperature, the outside air temperature, and the time period are given. For the simplicity of explanation, the in-store humidity as shown in FIG. 3 will not be used.

The in-store temperature and the outside air temperature are at the 5° C. interval and the time period is at the two-hour interval. For each cube defined by the three of the in-store temperature, the outside air temperature, and the time period, actual measurement values of the past defrosting time and recovery time are stored, and the average value of each of the stored actual measurement values is stored.

FIG. 5B shows one example of the past record data stored in a case in which the time period is from 0:00 to 2:00; the outside air temperature is between 15° C. and 20° C., and the in-store temperature is between 15° C. and 20° C. As shown in FIG. 5B, the database based on environmental conditions 13 is configured such that it can store for example 10 past record data for the environmental conditions of the outside air temperature between 15° C. and 20° C. and the in-store temperature between 15° C. and 20° C.

For example, in the first past record data, the defrosting time is 15 minutes and the recovery time is 28 minutes. In the second past record data, the defrosting time is 18 minutes and the recovery time is 32 minutes. Based on these ten past record data, the average defrosting time is computed as 16 minutes, while the average recovery time is computed as 29 minutes. The database based on environmental conditions 13 has a configuration such that it deletes the oldest past record data when more than 10 past record data are received for the cube. Also, it is not limited to the case in which the average values are computed but other representative values, such as a mode value or a median value also may be computed.

(2.3) Main Component of the Integrated Controller

Figure 6:
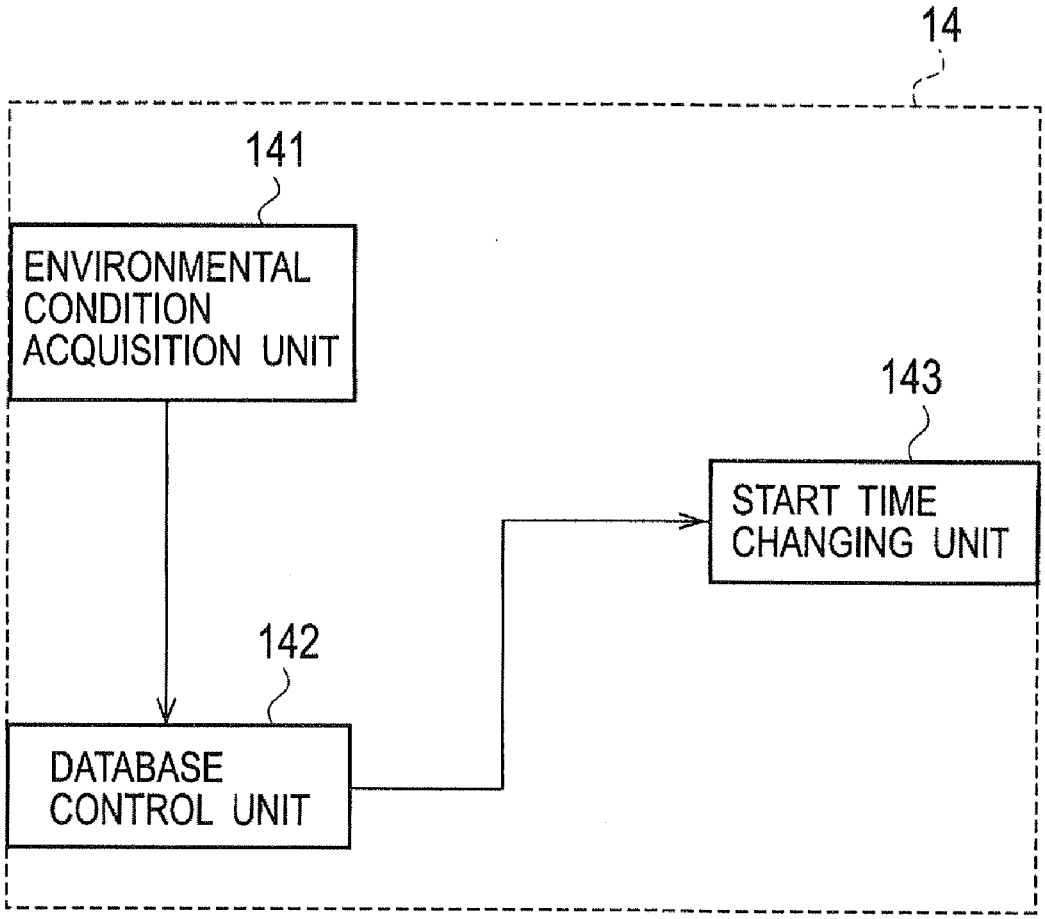
FIG. 6 is a functional block diagram showing each function performed by the CPU according to the embodiment.

FIG. 6 is a functional block diagram showing each function carried out at the CPU 14. As shown in FIG. 6, the CPU 14 includes an environmental condition acquisition unit 141, a database control unit 142, and a start time changing unit 143.

The environmental condition acquisition unit 141 obtains the present environmental conditions. As the environmental conditions, the above described in-store temperature, in-store humidity, outside air temperature, and time period may be included. Here, the in-store temperature is measured at the in-store temperature sensor 61. The in-store humidity is measured at the in-store humidity sensor 62. The outside air temperature is measured at the outside air temperature sensor 63. The time period is measured at the timer 17.

The database control unit 142 estimates at the time of or before the start of the present-round defrosting operation required time for the present-round defrosting operation based on the past record data corresponding to the present environmental conditions from among the past record data stored in the database based on environmental conditions 13. Also, since the 10 past record data are stored for each environmental condition as shown in FIG. 5B, the database control unit 142 computes an average value of the 10 past record data as the estimated required time. In this embodiment, the database control unit 142 constitutes a required time prediction unit for estimating the required time for the present-round defrosting operation.

The start time changing unit 143 changes the start time of the present-round defrosting operation based on the estimated required time obtained at the database control unit 142 from the defrosting start time according to a fixed or varying time interval (such as the four-hour or six-hour interval). In other words, the start time changing unit 143 changes the defrosting start time stored in the operation schedule database 12 (scheduled start time) based on the estimated required time obtained at the database control unit 142.

(2.4) Example Of Screen Display

Figure 7:
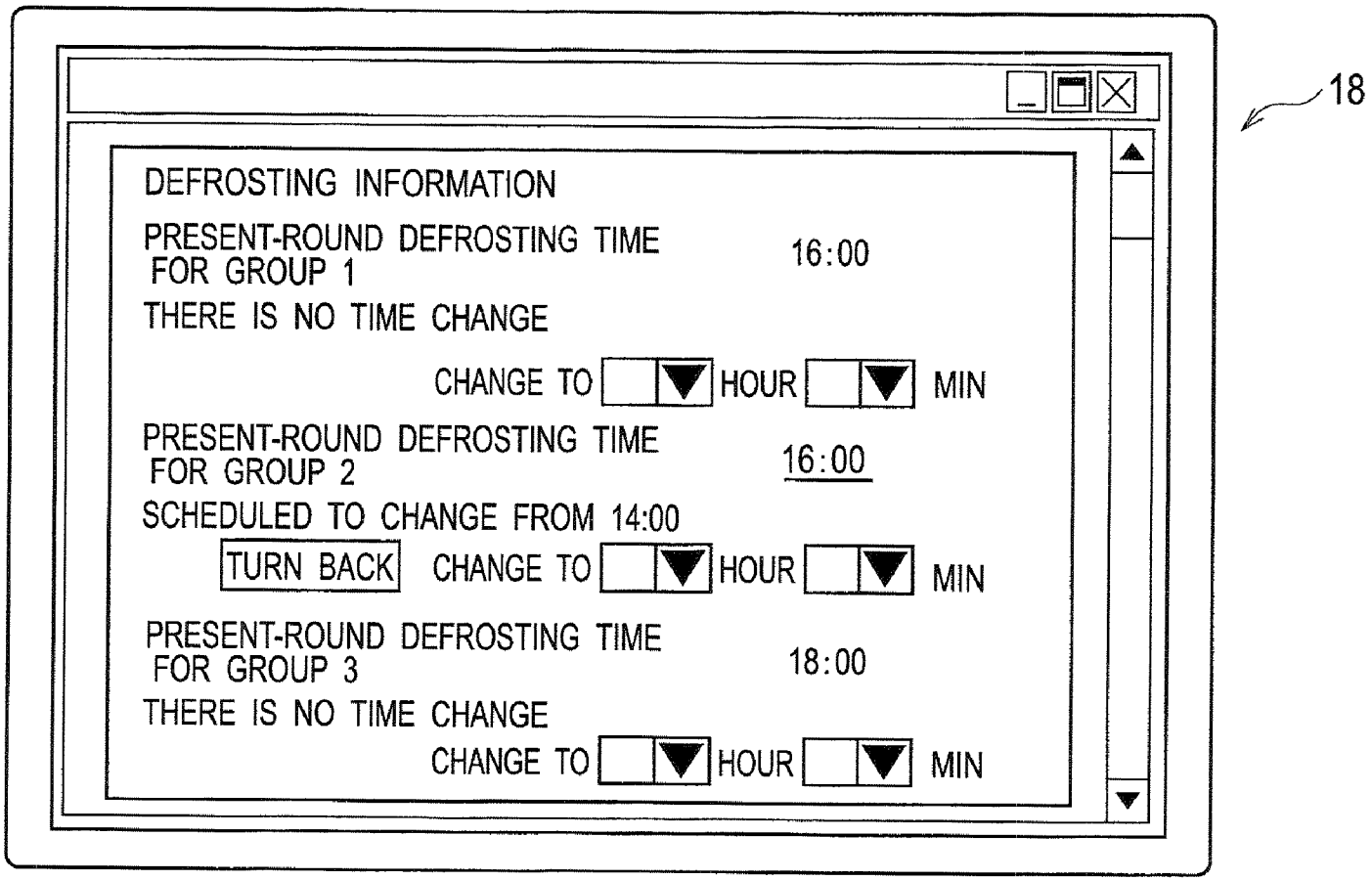
FIG. 7 is a view showing a configuration example of a display screen of the display unit according to the embodiment.

FIG. 7 is a view showing a configuration example of a display screen displayed at the display unit 18. In the example of FIG. 7, for each of the three groups of defrosting groups 1 to 3, the scheduled start time of the present-round defrosting is displayed. For example, the scheduled start time of the present-round defrosting for the defrosting group 1 is 16:00, while the scheduled start time of the present-round defrosting for the defrosting group 2 is 16:00 as a result of the change from 14:00, and the scheduled start time of the present-round defrosting for the defrosting group 3 is 18:00. In other words, it shows that the scheduled start time of the present-round defrosting was not changed for the defrosting groups 1 and 3. For the defrosting group 2, it is shown that the scheduled start time of the present-round defrosting was changed.

A "turn back" button is provided for the defrosting group 2 for which the scheduled start time of the present-round defrosting was changed so that the scheduled start time can be turned back to the original scheduled start time (the defrosting start time stored in the operation schedule database 12). The scheduled start time of the present-round defrosting can be put back to the original time (here, 14:00) by the user's pressing the button using the input unit 16.

In addition, for each of the three groups of defrosting groups 1 to 3, the scheduled start time of the present-round defrosting is arbitrarily changeable by the user. In particular, a button for changing the time is displayed and the scheduled start time of the present-round defrosting can be changed by the user by specifying the button using the input unit 16 and selecting the time from a pull-down menu. The display unit also includes a screen for notifying the contents of the change to the user (including the case in which there was no change) as a confirmation screen after the input by the user.

(3) Operations of the Integrated Controller

Next, operations of the integrated controller 10, in particular, (3.1) overall operations of the integrated controller, (3.2) determination processing of the defrosting start time change, (3.3) specific example of the defrosting start time change, and (3.4) display operations of the change result will be explained.

(3.1) Overall Operations of the Integrated Controller

Figure 8:
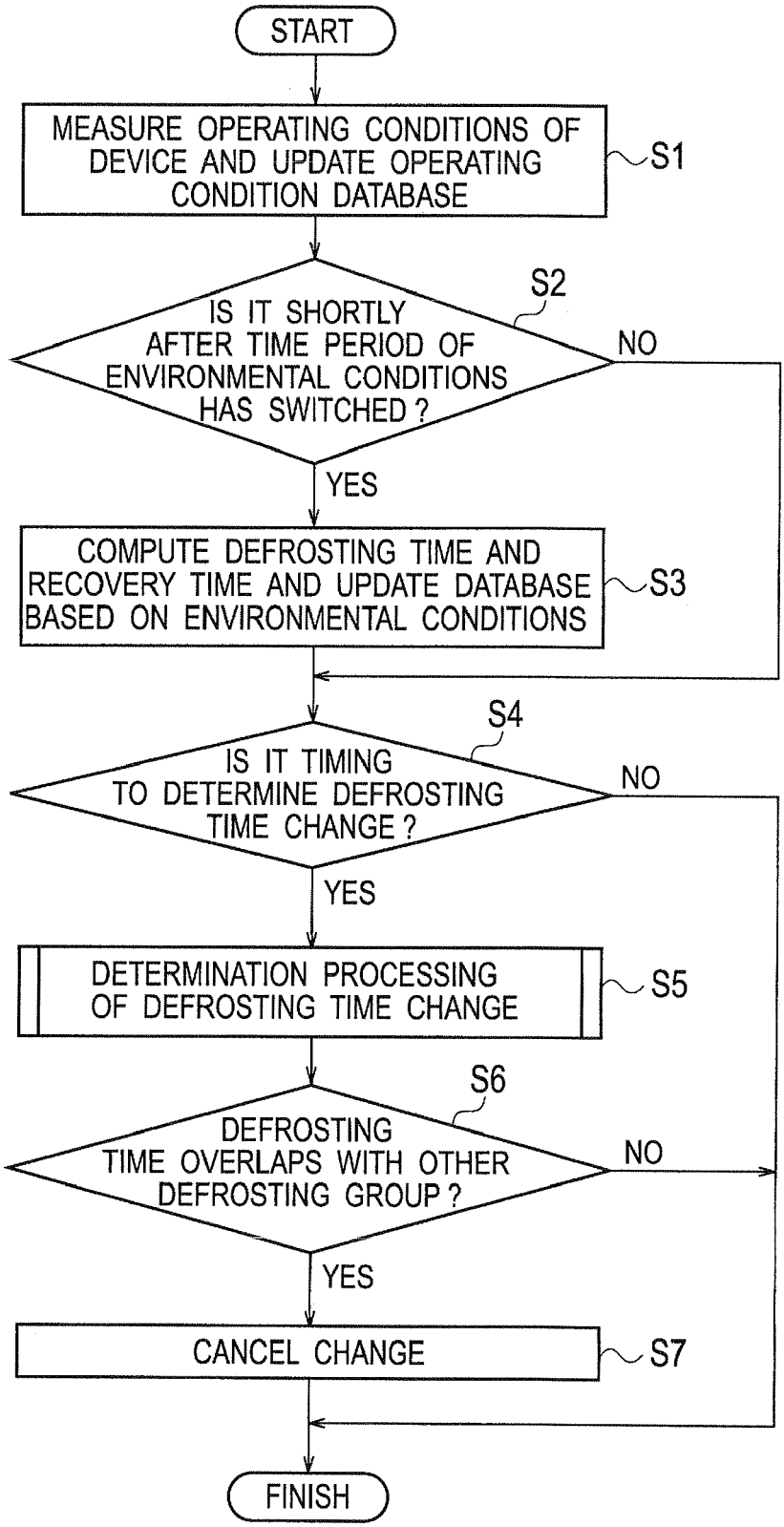
FIG. 8 is a flowchart showing the overall operations of the integrated controller 10 according to the embodiment.

FIG. 8 is a flowchart showing overall operations of the integrated controller 10. The processing flow as shown in FIG. 8 is executed periodically such as once every minute.

At step S1, the environmental condition acquisition unit 141 and the database control unit 142 measure the operation conditions of the showcases 53, 54, and 55 . . . such as the operation mode, the inside temperature of the showcase, and the environmental conditions, and store the measured contents in the operating condition database 11. As a result of this, the operating condition database 11 is updated.

At step S2, the database control unit 142 determines whether or not it is shortly after the time period, which is one of the environmental conditions, has switched. For example, when the time period is divided into two-hour time segments, the clock time such as 10:00 and 12:00 is the time "shortly after the time period has switched". At such time, the process advances to step S3.

At step S3, the database control unit 142 computes the defrosting time and the recovery time from the contents stored in the operating condition database 11. The defrosting time can be obtained by measuring the time in which the operation mode is in the defrosting mode. The recovery time can be obtained by measuring the time from the finish time of the defrosting operation until when the inside temperature of the showcase becomes equal to a preset temperature, or until when the temperature difference between the inside temperature of the showcase and the preset temperature becomes within a certain value.

The database control unit 142 sets the defrosting time and recovery time obtained as such in a corresponding cell of the database based on environmental conditions 13. The corresponding cell is determined by a parameter such as the average temperature within the present time period (2 hours). In addition, when a substantial amount of data (such as 10) is set in the corresponding cell, the database control unit 142 updates the database by deleting the oldest data.

At step S4, the start time changing unit 143 determines whether or not it is time to determine defrosting start time change. This determination time for example is five minutes before the defrosting start time. This is for determining the start time change before the defrosting start time so as to prompt the user to determine by displaying the change result of the defrosting start time on the screen. However, in a configuration that the change result of the defrosting start time is not displayed on the screen, the defrosting start time change may be determined right before the defrosting start time.

If it is time to determine the defrosting start time change, the process advances to step S5. At step S5, the start time changing unit 143 carries out the determination processing of the defrosting start time change. This processing will be described in detail below.

At step S6, the start time changing unit 143 determines whether or not the changed defrosting start time for one defrosting group overlaps with the defrosting start time for another defrosting group. If the changed defrosting start time overlaps with the defrosting start time of another defrosting group, a large number of showcases will start their defrosting operations all at once. This is not desirable because the electric power consumption associated with the defrosting operation and the recovery operation becomes concentrated in a short period of time.

Therefore, at step S7, when the changed defrosting start time overlaps with the defrosting start time of another defrosting group, the start time changing unit 143 cancels the changing process. When the changing process is cancelled, the defrosting start time returns to the scheduled start time.

(3.2) Determination Processing of the Defrosting Start Time CHANGE

Figure 9:
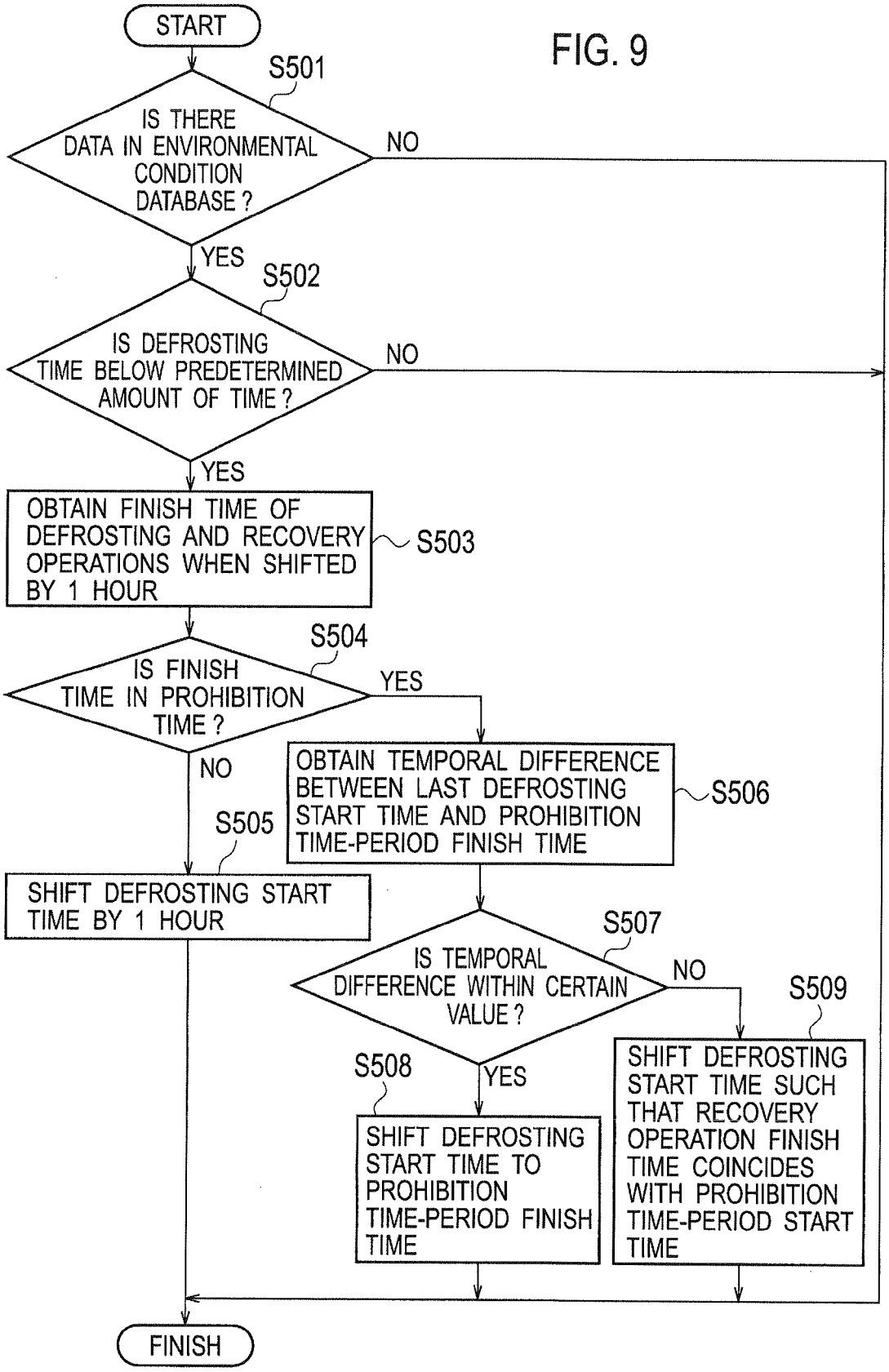
FIG. 9 is a flowchart showing the details of the determination processing of the defrosting start time change, that is, step S5 of FIG. 8 according to the embodiment.

FIG. 9 is a flowchart showing the determination processing of the defrosting start time change, that is, step S5 of FIG. 8.

At step S501, the environmental condition acquisition unit 141 obtains the present environmental conditions. The database control unit 142 determines whether or not the past record data that corresponds to the present environmental conditions (such as the average defrosting time and the average recovery time) exist in the database based on the environmental conditions 13. Here, the past record data that corresponds to the present environmental conditions is not limited to the past record data that coincides (perfectly matches) with the present environmental conditions but the past record data may be those having the difference with the present environmental conditions of within a certain value. When the past record data that corresponds with the present environmental conditions exists in the database based on environmental conditions 13, the process advances to step S502.

At step S502, the start time changing unit 143 determines whether or not the average defrosting time in the past record data corresponding to the present environmental conditions is below a certain period of time (such as 15 minutes). This certain period of time is an indicator for evaluating the amount of the adhered frost in the showcase and it differs depending on the property of the showcase. Therefore, it is necessary that the evaluation criteria be estimated in advance such as by experiments and trial operations. When the average defrosting time is below the certain period of time, the process advances to step S503.

At step S503, the start time changing unit 143 obtains finish time of the recovery operation in a case in which it is presumed that the present-round defrosting start time is delayed by one hour from the scheduled start time. In particular, the start time changing unit 143 derives the finish time of the recovery operation by adding the average defrosting time and the average recovery time to the time delayed by 1 hour from the scheduled start time. In this regard, safety margin (such as 3 minutes) may be added on the assumption that the defrosting time is extended by the 1-hour delay of the defrosting start time.

At step S504, the start time changing unit 143 determines whether or not the finish time of the recovery operation derived at step S503 spans into the prohibition time period. The prohibition time period can be determined by referring to the operation schedule database 12. If the finish time of the recovery operation does not span into the prohibition time period, the process advances to step S505. On the other hand, if the finish time of the recovery operation spans into the prohibition time period, the process advances to step S506.

At step S505, the start time changing unit 143 delays the present-round defrosting start time by 1 hour.

At step S506, the start time changing unit 143 obtains the last defrosting start time and the prohibition time period finish time, and computes a temporal difference between the last defrosting start time and the prohibition time period finish time.

At step S507, the start time changing unit 143 determines whether or not the temporal difference computed at step S506 is within a certain value. Here, the certain value is based on the time interval of the defrosting operation in the initial state (such as at the four-hour or six-hour interval) for virtually assuring prevention of the frost adherence as long as the defrosting operation is performed within such a certain value. For this certain value also, it is necessary that evaluation criteria be estimated in advance such as by experiments and trial operations. When the temporal difference computed at step S506 is within the certain value, the process advances to step S508. On the other hand, if the temporal difference computed at step S506 exceeds the certain value, then the process advances to step S509.

At step S508, the start time changing unit 143 delays the present-round defrosting operation start time until the prohibition time period finish time. Alternatively, the present-round defrosting operation start time can be made after the prohibition time period finish time.

At step S509, the start time changing unit 143 delays the present-round defrosting operation start time such that the finish time of the recovery operation associated with the present-round defrosting operation coincides with the prohibition time period start time. Alternatively, the finish time of the recovery operation may be set before the start time of the prohibition time period.

(3.3) Specific Example of the Defrosting Start Time Change

Next, by referring to the flowchart as shown in FIG. 9, specific examples of the defrosting start time change will be explained using FIGS. 10A to 10D. FIGS. 10A to 10D are conceptual views showing specific examples of the defrosting start time change.

Figures 10A, 10B, 10C, 10D:
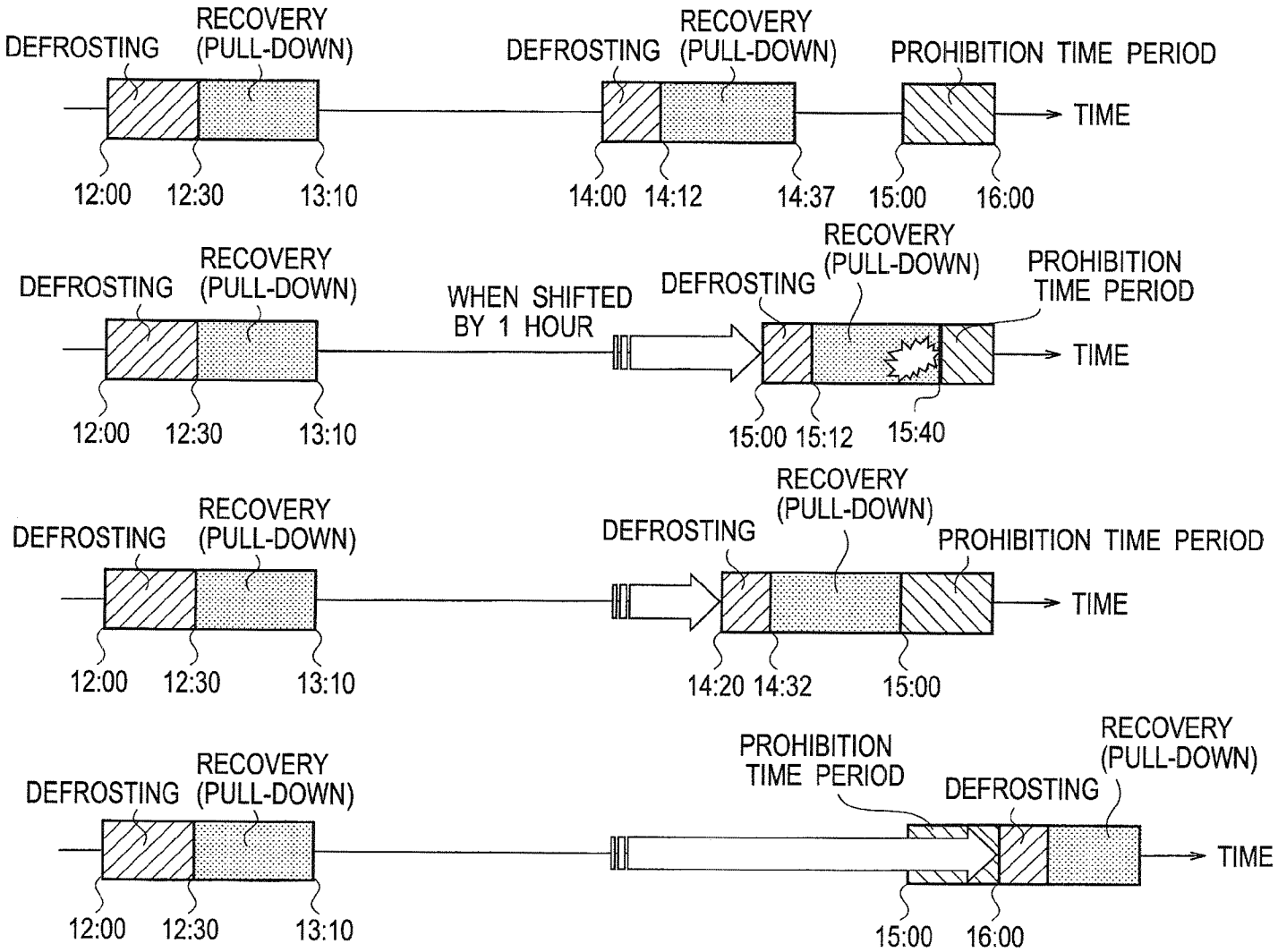
FIGS. 10A to 10D are conceptual views showing an example of the determination processing of the defrosting start time change according to the embodiment.

FIG. 10A shows a state before the defrosting start time is changed. It is assumed that the scheduled defrosting start time of the present-round defrosting operation is 14:00; the average defrosting time corresponding to the present environmental conditions is 12 minutes; and the average recovery time corresponding to the present environmental conditions is 25 minutes. Since the average defrosting time (12 minutes) is less than the certain period of time (e.g. 15 minutes), the start time changing unit 143 determines that the start time of the present-round defrosting operation be delayed (step S502: YES). Also, at FIG. 1A, the last defrosting is performed from 12:00 to 12:30, and the last recovery operation is performed from 12:30 to 13:10. The prohibition time period is set from 15:00 to 16:00.

FIG. 10B shows a state in a case in which it is assumed that the defrosting start time of the present-round defrosting operation is delayed by one hour. In this case, the finish time of the recovery operation associated with the present-round defrosting operation is 15:40 from 14:00 (the scheduled start time)+1 hour+12 minutes (the average defrosting time)+25 minutes (the average recovery time)+3 minutes (safety margin) (step S503). In this case, it is determined that the finish time of the recovery operation (15:40) spans into the prohibition time period (15:00 to 16:00) (step S504: YES).

Therefore, the start time changing unit 143 computes the temporal difference between the last defrosting operation start time and the prohibition time period finish time (16:00). In this case, the temporal difference is computed as being 4 hours (step S506).

FIG. 10C shows a state in a case in which it is assumed that the certain value to be compared with the temporal difference at step S506 is being 3 hours. In this case, it is determined that the temporal difference (4 hours) exceeds the certain value (3 hours) (step S507: NO). Therefore, the start time changing unit 143 delays the start time of the present-round defrosting operation such that the finish time of the recovery operation associated with the present-round defrosting operation coincides with the start time of the prohibition time period (15:00) (step S509). More specifically, the present-round defrosting operation start time is made 14:20 from the prohibition time period start time (15:00)−3 minutes (safety margin)−25 minutes (the average recovery time)−12 minutes (the average defrosting time)=14:20.

FIG. 10D shows a state in a case in which it is assumed that the certain value to be compared with the temporal difference at step S506 is being 4 hours. In this case it is determined that the temporal difference (4 hours) is within the certain value (4 hours) (step S507: YES), and the start time changing unit 143 makes the finish time of the prohibition time period (16:00) to be the start time of the present-round defrosting operation (step S508).

(3.4) Displaying Operations of Change Results

Figure 11:
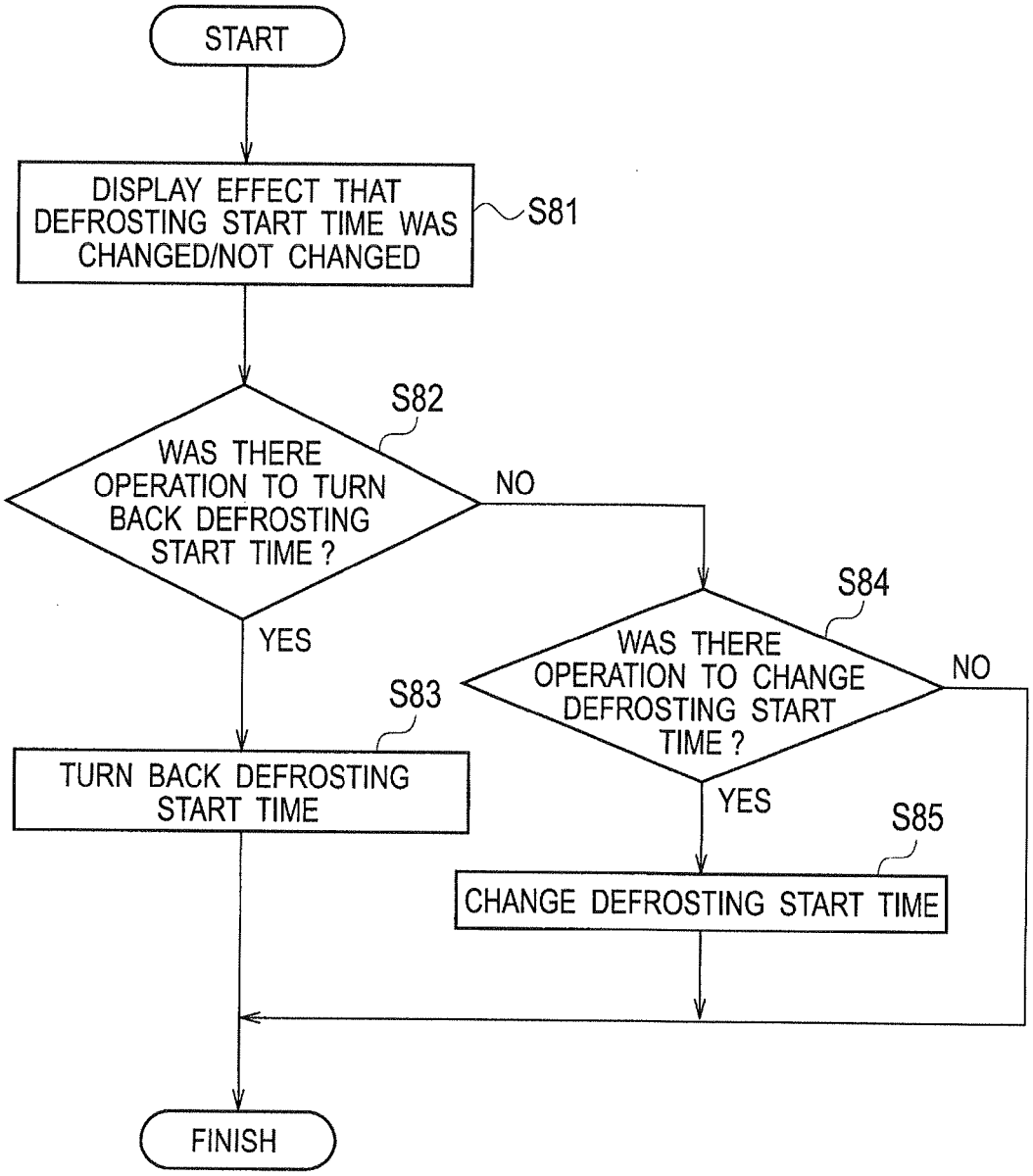
FIG. 11 is a flowchart showing a change result display operation according to the embodiment.

FIG. 11 is a flowchart showing display operations of the change results.

At step S81, the display unit 18 displays the effect that the present-round defrosting start time has been changed or has not been changed. Such a display is carried out for example for each defrosting group. When the effect of change is displayed, the changed start time is displayed in addition to the original scheduled start time.

At step S82, the start time changing unit 143 determines whether or not there was an operation from the user at the input unit 16 to turn back the defrosting operation start time to the original scheduled start time. If there is an operation to turn back the defrosting start time to the original scheduled start time, the process advances to step S83. On the other hand, if there is no operation to turn back the defrosting start time to the original scheduled start time, the process advances to step S84.

At step S83, the start time changing unit 143 turns back the defrosting start time to the original scheduled start time.

At step S84, the start time changing unit 143 determines whether or not there was an operation from the user at the input unit 16 to change the defrosting operation start time. If there is an operation to change the defrosting operation start time, the process advances to step S85.

At step S85, the start time changing unit 143 changes the defrosting operation start time to the start time specified by the user according to the operation by the user at the input unit 16.

(4) Operations and Effect

The integrated controller 10 according to the embodiment estimates the present-round defrosting operation time in accordance with the past defrosting operation time corresponding to the present environmental conditions, and changes the present-round defrosting start time from the original scheduled start time based on the estimated present-round defrosting operation time. Therefore, even when the environmental conditions at the time of the last defrosting operation differ greatly from the environmental conditions at the time of the present-round defrosting operation, the present-round defrosting start time can be changed appropriately.

The integrated controller 10 according to the embodiment delays the present-round defrosting start time from the original scheduled start time when the estimated required time falls below a predetermined amount of time by regarding that it has a tendency to have a small amount of the adhered frost. Therefore, the time interval of the defrosting operations can be extended when it is considered that the amount of the adhered frost is small, thus decreasing the electric power consumption associated with the defrosting operation and the recovery operation.

According to the integrated controller 10 of the embodiment, the present-round defrosting operation start time can be changed from the scheduled start time while avoiding the overlap of the defrosting operation and the recovery operation with the prohibition time period. In particular, the integrated controller 10 delays the present-round defrosting start time until after the finish time of the prohibition time period when the temporal difference between the last defrosting start time and the finish time of the prohibition time period is below a certain value, that is, in a case in which it can be determined that the cooling performance of the showcases 53, 54, and 55 . . . does not become impaired by delaying the present-round defrosting start time until after the finish time of the prohibition time period. Therefore, the electric power consumption associated with the defrosting operation and the recovery operation can be decreased by extending the time interval of the defrosting operations as much as possible while avoiding to impair the cooling performance of the showcases 53, 54, and 55 . . . and while avoiding that the defrosting operation time overlaps with the prohibition time period.

Also, the integrated controller 10 delays the present-round defrosting start time such that the present-round defrosting finish time comes before the start time of the prohibition time period when the temporal difference between the last defrosting start time and the finish time of the prohibition time period exceeds the certain value, that is, in a case in which it is determined that there is a possibility that the cooling performance of the showcases 53, 54, and 55 . . . may be impaired by delaying the present-round defrosting start time until after the finish time of the prohibition time period. Therefore, the electric power consumption associated with the defrosting operation and the recovery operation can be decreased by extending the time interval of the defrosting operations as much as possible while avoiding to impair the cooling performance of the showcases 53, 54, and 55 . . . and while avoiding that the defrosting operation time overlaps with the prohibition time period.

According to the integrated controller 10 of the embodiment, the defrosting start time of the showcase 53 of the defrosting group 1 is changed such that it does not overlap with the defrosting start time of the showcase 54 of the defrosting group 2 and the defrosting start time of the showcase 55 of the defrosting group 3. Therefore, the electric power consumption associated with the defrosting operation can be temporally spread by staggering the defrosting start time among the showcases (among the defrosting groups).

In addition, the integrated controller 10 displays the effect of whether the present-round defrosting start time was changed or not from the original scheduled start time. Therefore, the user can grasp whether the present-round defrosting start time was changed or not from the original scheduled start time.

(5) Other Embodiments

As described above, the present invention was described using the embodiments. However, the descriptions and the drawings that constitute a part of this disclosure should not be regarded as being restrictive. From this disclosure, various alternative embodiments, examples, and operative technologies become apparent for one skilled in the art.

(5.1) Other Embodiments

In the above embodiment, the defrosting start time of the defrosting group 1 was changed such that it does not overlap with the defrosting start time of the defrosting group 2 and the defrosting start time of the defrosting group 3.

However, not only avoiding the overlap of the start times, the defrosting start time of the defrosting group 1 may be changed such that the defrosting time of the defrosting group 1 does not overlap with the defrosting time of the defrosting group 2 and the defrosting time of the defrosting group 3. This enables assuring further distribution of the electric power consumption associated with the defrosting operation.

Such decentralization of the electric power consumption is particularly effective in the demand contract method, which is one of the contract methods for the electricity rate placed between an owner of a store or a facility and an electric power company. In the demand contract method, the integrated value of the electric power consumption (which will be called "power consumption integrated value" below) is computed for each predetermined term (which will be called "demand term" below), and the contract rate is set based on the maximum power consumption integrated value among the power consumption integrated values for the demand terms in the period of one year.

Therefore, for the owner of the store or the facility, it is desired to keep the power consumption integrated value per demand term low. Thus, by temporally decentralizing the electric power consumption associated with the defrosting operation and the recovery operation, the power consumption integrated value per demand term can be kept low, and as such there is an advantage in the demand contract method in decreasing the contract rate.

(5.2) Modified Example 2

In the above-described embodiment, when the estimated required time falls below a predetermined amount of time, the present-round defrosting start time was delayed from the original scheduled start time by considering that it has a tendency to have a small amount of the adhered frost. However, it is not limited to the case in which the present-round defrosting start time is delayed from the scheduled start time, but the present-round defrosting start time may be advanced from the scheduled start time.

In particular, the start time changing unit 143 advances the present-round defrosting start time from the scheduled start time when the estimated required time exceeds a predetermined amount of time. This makes it possible to shorten the time interval of the defrosting operation when it is considered that the amount of the adhered frost is large, thus maintaining a good cooling performance of the showcases 53, 54, and 55 . . . . In this embodiment also, a person skilled in the art should be able to apply various processing of the above-described embodiment easily.

(5.3) Modified Example 3

In the above-described embodiment, a system configuration to refrigerate and freeze merchandises in the showcases placed such as in a store was described. However, the invention also is applicable to an air conditioning system for an indoor space such as a store.

Figure 12B:
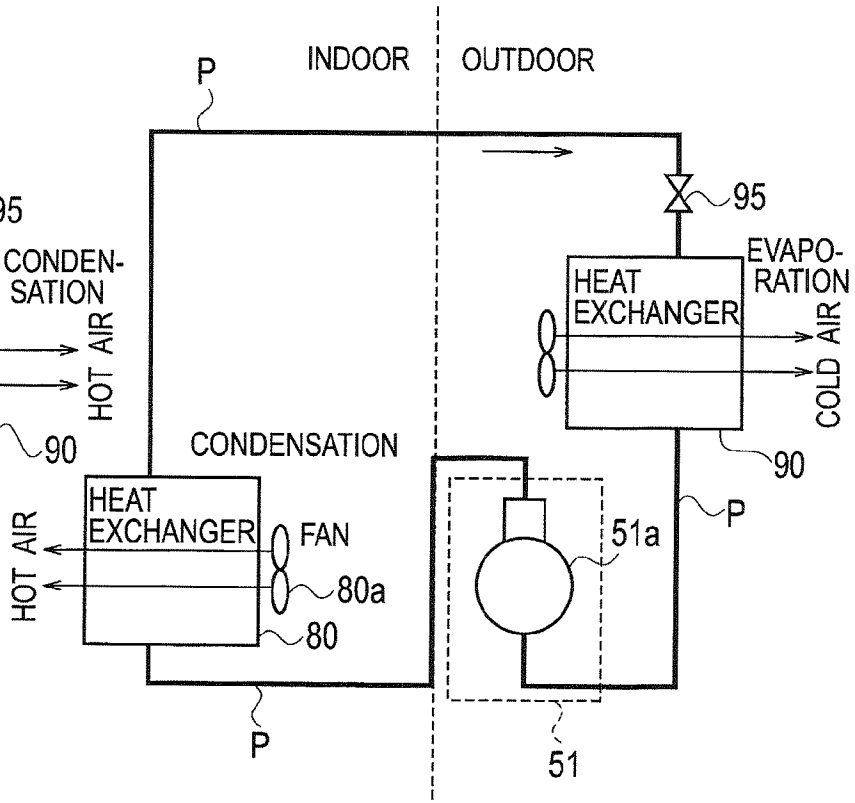
FIGS. 12A and 12B are views for explaining examples of an application of the invention to an air conditioning system.
Figure 12A:
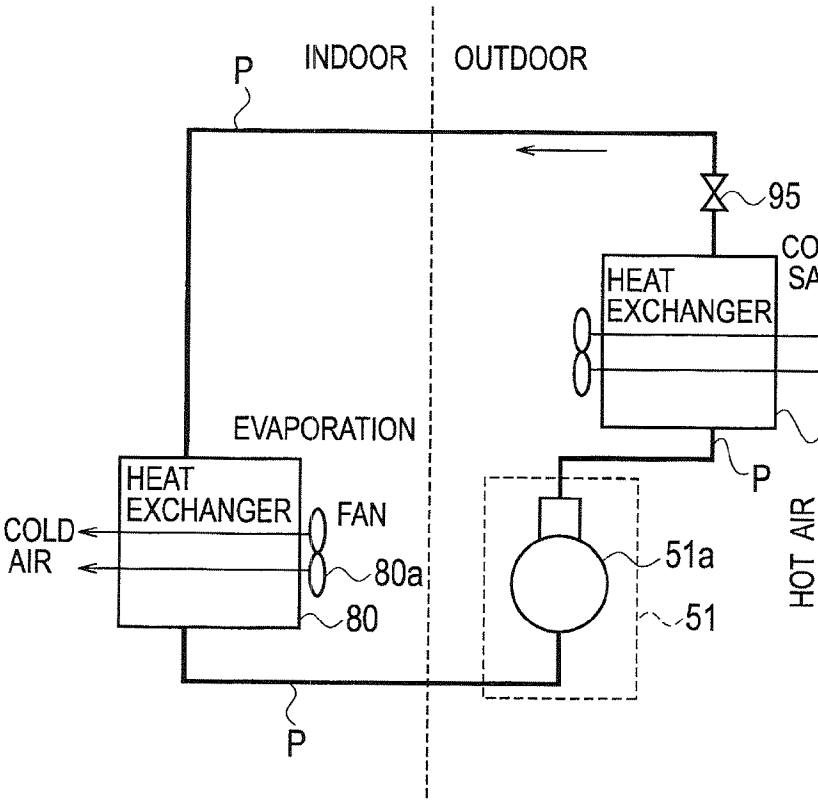

FIGS. 12A and 12B are views for explaining examples of an application of the invention to the air conditioning system. In FIGS. 12A and 12B, each of a compressor 51, heat exchangers 80 and 90, and an expansion valve 95 is a constituent device that constitutes the refrigerant circulation circuit and is connected by refrigerant piping P. In the air conditioning system, at the time of refrigerated air conditioning, the refrigerant is circulated as shown in FIG. 12A. On the other hand, at the time of air heating, the refrigerant path is switched and the refrigerant is circulated as shown in FIG. 12B.

For example, at the time of the air heating operation as shown in FIG. 12B, the heat exchanger 90 at the outdoor side constitutes a cooling device for cooling the outside air (the space to be cooled), thus requiring periodical defrosting operations. Here, as described above, the environmental conditions at the time of the defrosting operation affect the required time for the defrosting operation. Therefore, similarly to the above-described embodiment, for the defrosting operation of the heat exchanger 90 also, the present-round defrosting start time can be appropriately changed by estimating the required time for the present-round defrosting operation according to the required time for the past defrosting operations corresponding to the present environmental conditions, and changing the start time of the present-round defrosting operation based on the estimated required time from the scheduled start time.

(5.4) Modified Example 4

In the above-described embodiment, the environmental condition acquisition unit 141, the database control unit 142, and the start time changing unit 143 were provided at the integrated controller 10. However, a system configuration also is possible in which these functional blocks are scattered into individual device controllers.

(5.5) Computer Program

It is possible to implement each processing explained in the above-described embodiment as a computer program and to have it executed by a computer as the integrated controller 10 or as a device controller.

The present invention may be embodied in other specific forms without departing from the spirit or essential characteristics thereof. The embodiments are therefore to be considered in all respects as illustrative and not restrictive, the scope of the present invention being indicated by the appended claims rather than by the foregoing description, and all changes that come within the meaning and range of equivalency of the claims therefore are intended to be embraced therein.

What is claimed is:

1. An equipment control system comprising:

a refrigeration device for cooling a space to be cooled;

a control device for controlling a defrosting operation to remove frost adhered to the refrigeration device, the defrosting operation being started at a fixed or varying time interval;

a past record data memory unit for storing past record data based on required time for past defrosting operations for different environmental conditions;

an environmental condition acquisition unit for obtaining present environmental conditions;

a required time prediction unit for estimating, at the time of or before starting a present-round defrosting operation, required time for a present-round defrosting operation based on the past record data corresponding to the present environmental conditions from among the past record data stored in the past record data memory unit; and a start time changing unit for changing start time of the present-round defrosting operation based on the estimated required time obtained at the required time prediction unit from start time that was scheduled based on the time interval, wherein the start time changing unit changes the start time of the present-round defrosting operation from the scheduled start time such that the defrosting operation time period does not overlap with a prohibition time period in which the defrosting operation is prohibited, and the start time changing unit delays the start time of the present-round defrosting operation until after finish time of the prohibition time period when the estimated required time obtained at the required time prediction unit falls below a predetermined amount of time and a temporal difference between the start time of the last defrosting operation and the finish time of the prohibition time period is below a certain value.

2. The equipment control system of claim 1, wherein the start time changing unit delays the start time of the present-round defrosting operation such that finish time of the present-round defrosting operation comes before the start time of the prohibition time period when the estimated required time obtained at the required time prediction unit falls below a predetermined amount of time and a temporal difference between the start time of the last defrosting operation and the finish time of the prohibition time period exceeds a certain value.

3. The equipment control system of claim 1, wherein the refrigeration device includes a first refrigeration device and a second refrigeration device that is different from the first refrigeration device, and wherein when the start time of the present-round defrosting operation for the first refrigeration device is changed, the start time changing unit sets the start time of the present-round defrosting operation for the first refrigeration device to be different from the start time of the defrosting operation for the second refrigeration device.

4. The equipment control system of claim 1, further comprising a notification unit for notifying to a user an effect that the start time of the present-round defrosting operation was changed from the scheduled start time or an effect that there is no change in the start time.

5. An equipment control system comprising:

a refrigeration device for cooling a space to be cooled;

a control device for controlling a defrosting operation to remove frost adhered to the refrigeration device, the defrosting operation being started at a fixed or varying time interval;

a past record data memory unit for storing past record data based on required time for past defrosting operations for different environmental conditions;

an environmental condition acquisition unit for obtaining present environmental conditions;

a required time prediction unit for estimating, at the time of or before starting a present-round defrosting operation, required time for a present-round defrosting operation based on the past record data corresponding to the present environmental conditions from among the past record data stored in the past record data memory unit; and a start time changing unit for changing start time of the present-round defrosting operation based on the estimated required time obtained at the required time prediction unit from start time that was scheduled based on the time interval, wherein the start time changing unit changes the start time of the present-round defrosting operation from the scheduled start time such that the defrosting operation time period does not overlap with a prohibition time period in which the defrosting operation is prohibited, and the start time changing unit delays the start time of the present-round defrosting operation such that finish time of the present-round defrosting operation comes before the start time of the prohibition time period when the estimated required time obtained at the required time prediction unit falls below a predetermined amount of time and a temporal difference between the start time of the last defrosting operation and the finish time of the prohibition time period exceeds a certain value.

6. The equipment control system of claim 5, wherein the refrigeration device includes a first refrigeration device and a second refrigeration device that is different from the first refrigeration device, and wherein when the start time of the present-round defrosting operation for the first refrigeration device is changed, the start time changing unit sets the start time of the present-round defrosting operation for the first refrigeration device to be different from the start time of the defrosting operation for the second refrigeration device.

7. The equipment control system of claim 5, further comprising a notification unit for notifying to a user an effect that the start time of the present-round defrosting operation was changed from the scheduled start time or an effect that there is no change in the start time.

* * * * *